US006003713A

United States Patent [19]

Derving

[11] Patent Number: 6,003,713

[45] Date of Patent: Dec. 21, 1999

[54] OPENING ARRANGEMENT FOR PACKAGING CONTAINERS

[75] Inventor: Jackie Derving, Malmö , Sweden

[73] Assignee: Tetra Laval Holdings & Finance S.A., Pully, Switzerland

[21] Appl. No.: 09/087,957

[22] Filed: Jun. 1, 1998

[30] Foreign Application Priority Data

Jul. 4, 1997 [SE] Sweden ..... 9702590

[51] Int. Cl.[6] ..... B65D 17/34

[52] U.S. Cl. ..... 220/269; 220/833; 220/834; 220/837; 220/839

[58] Field of Search ..... 220/269, 833, 220/834, 837, 839

[56] References Cited

U.S. PATENT DOCUMENTS

| | | | |
|---|---|---|---|
| 3,095,995 | 7/1963 | Foster | 220/833 X |
| 3,658,238 | 4/1972 | Nedstedt . | |
| 3,998,354 | 12/1976 | Song | 220/269 |
| 4,258,876 | 3/1981 | Ljungcrantz . | |
| 4,301,939 | 11/1981 | Pupp . | |
| 4,387,820 | 6/1983 | Ignell . | |
| 4,391,385 | 7/1983 | Rausing | 220/269 |
| 4,399,924 | 8/1983 | Nilsson . | |
| 4,718,598 | 1/1988 | Pupp et al. . | |
| 4,804,134 | 2/1989 | Reil . | |
| 4,838,428 | 6/1989 | Rausing . | |
| 4,852,764 | 8/1989 | Stone | 220/315 |
| 4,895,298 | 1/1990 | Reil . | |
| 4,913,294 | 4/1990 | Giacomelli . | |
| 4,986,465 | 1/1991 | Jacobsson et al. . | |
| 4,990,200 | 2/1991 | Heinz | 220/837 X |
| 5,199,618 | 4/1993 | Reil et al. . | |
| 5,484,101 | 1/1996 | Hedberg . | |

FOREIGN PATENT DOCUMENTS

| | | |
|---|---|---|
| 0 303 976 | 2/1989 | European Pat. Off. . |
| 2 459 180 | 1/1981 | France . |

*Primary Examiner*—Stephen K. Cronin
*Attorney, Agent, or Firm*—Burns, Doane, Swecker & Mathis, L.L.P.

[57] ABSTRACT

An opening arrangement for packaging containers designed so as to prevent splashing or spraying of liquid contents on reclosure of the opening arrangement. The opening arrangement (1) has a closure device (4) with a front end depressable into the pouring opening (5) of the opening arrangement, and a rear compression portion (10) of greater cross sectional area than the pouring opening (5). The compression portion (10) includes arrest heels (14) facing towards the pouring opening (5), the arrest heels, on reclosure of the opening arrangement, coming into contact with the wall surface (3) located around the pouring opening (5) and preventing any possible residual contents (9) thereon from causing splashing in connection with the reclosure operation.

8 Claims, 1 Drawing Sheet

OPENING ARRANGEMENT FOR PACKAGING CONTAINERS

TECHNICAL FIELD

The present invention relates to an opening arrangement for packaging containers comprising a wall surface with an openable pouring opening and a closure device with a front end in the form of a sealing portion depressable in the pouring opening and a rear end in the form of a compression portion whose cross sectional area is greater than the cross sectional area of the pouring opening.

BACKGROUND ART

Packaging containers for certain consumer products, for example liquid foods such as milk, juice or the like are often manufactured from a flexible material which is folded and sealed for the formation of a packaging container possessing the desired size and configuration. Known types of packaging materials of this nature comprise laminates with layers of, for example, plastic, paper and aluminium foil. It is also known in the art to produce packaging containers for liquid consumer goods entirely of plastic material, and combinations of laminates and plastic materials are also known in the art, for example in a package of the Tetra Top® type. This packaging type includes a tubular casing of laminated paper/plastic material whose one end, by folding and sealing, forms a substantially planar bottom. The upper end of the packaging container consists of injection moulded plastic material, for example polyethylene, which makes it possible to design an upper portion with an opening arrangement of optional type. The opening arrangement must be easy to open, an object which is attained in that an openable portion is demarcated and defined from the upper wall surface of the packaging container by means of a weakening line of the desired configuration. The opening arrangement must, moreover, be reclosable and consequently displays a closure device which is capable of being pressed down into the pouring so that it substantially seals against the edges of the pouring opening. The closure device is provided with a rear compression portion which displays a projecting flange which, on reclosure of the packaging container, comes into abutment against the upper wall surface of the packaging container. This type of closure device is common and occurs in a plurality of different, per se known packaging types where the closure device displays a projecting edge or flange which, by abutment against the edge surrounding the pouring opening, prevents the closure device from being forced down completely into the pouring opening and possibly falling down into the interior of the packaging container. A disadvantage inherent in this type of closure device is, however, that possible residues of the contents which have been poured out through the pouring opening and, in such instance, have remained along the edge of the pouring opening are pressed aside by the flange of the closure device when this, on reclosure of the packaging container, is brought into contact at a certain speed with the edge located around the pouring opening and with residual contents located on this edge. This results in residual contents being pressed out over the upper wall surface of the package and, on rapid closing of the closure device, may even make the contents splash outside the circumference of the packaging container which, in unfortunate cases, may dirty the clothes of the consumer or other nearby objects. This problem is particularly accentuated in the type of closure device which is reclosed with a snap action, i.e. closure devices which, for example, have a sealing lip which must pass over a portion of the pouring opening for the closure device to come into a completely reclosed position. When the sealing lip passes the edge of the pouring opening or the narrowest region, a certain compression force is required which, when the sealing lip has passed, results in the flange of the closure device coming into contact at relatively high speed with the wall surface of the packaging container extending around the pouring opening so that droplets of contents located thereon are forcibly flung out from the packaging container. While the problem in the present patent application is principally described in connection with the above-mentioned packaging container type, it occurs, of course, in all types of reclosable packages when similar opening/closure devices are employed. There is, therefore, a general need in the art to realise an opening arrangement which obviates, or in any event greatly reduces the above-outlined problems and makes it possible to reclose a partly emptied packaging container without any possible residual contents causing splashing from the opening region of the packaging container.

OBJECTS OF THE INVENTION

One object of the present invention is thus to realise an opening arrangement of the reclosable type which makes it possible to reclose packaging containers for liquid contents without the risk of splashing or other similar inconveniences.

A further object of the present invention is to realise an opening arrangement which is particularly intended for packaging containers of the above-mentioned type and which, in a simple, economical and reliable manner, reduces the risk of splashing or spraying of contents when the packaging container is reclosed.

Yet a further object of the present invention is to realise an opening arrangement for packaging containers of the above-mentioned type, the opening arrangement obviating the risk of splashing on reclosure of packaging containers which include an opening arrangement which is injection moulded in one piece with the upper wall surface of the packaging container.

Still a further object of the present invention is, finally, to realise an opening arrangement for packaging containers which displays dependable and reliable function even in the event of repeated opening and closing of the packaging container.

SOLUTION

These and other objects have been attained according to the present invention in that an opening arrangement for packaging containers including a wall surface with an openable pouring opening and a closure device with a front end in the form of a sealing portion depressable into the pouring opening and a rear end in the form of a compression portion whose cross sectional area is larger than the cross sectional area of the pouring opening has been given the characterizing feature that arrest heels mechanically cooperable with the edge of the pouring opening are disposed at the end of the sealing portion facing towards the compression portion.

Preferred embodiments of the opening arrangement according to the present invention have further been given the characterizing features as set forth in the appended subclaims.

By designing, according to the present invention, the closure device of the opening arrangement with means for mechanical movement restriction in the form of arrest heels mechanically cooperable with the edge of the pouring opening, the projecting edge of the compression portion is prevented, on reclosure of the closure device, from being forced down at high speed against the wall surface surrounding the pouring opening, which prevents the occurrence of splashing or spraying even if the wall surface in the edge region around the pouring opening is coated with residual contents. By providing the otherwise previously known opening arrangement with a number of arrest heels distributed along the flange of the compression portion, the above-outlined drawbacks will thus be elegantly obviated, which, particularly in the above-described packaging type displaying an injection moulded opening arrangement and upper wall surface, may be put into effect without any increased degree of complexity and at extremely insignificant extra cost.

BRIEF DESCRIPTION OF THE ACCOMPANYING DRAWINGS

One preferred embodiment of the opening arrangement according to the present invention will now be described in greater detail hereinbelow, with particular reference to the accompanying Drawings which show only those details indispensable to an understanding of the invention. In the accompanying Drawings.

DESCRIPTION OF PREFERRED EMBODIMENT

Figure 1:
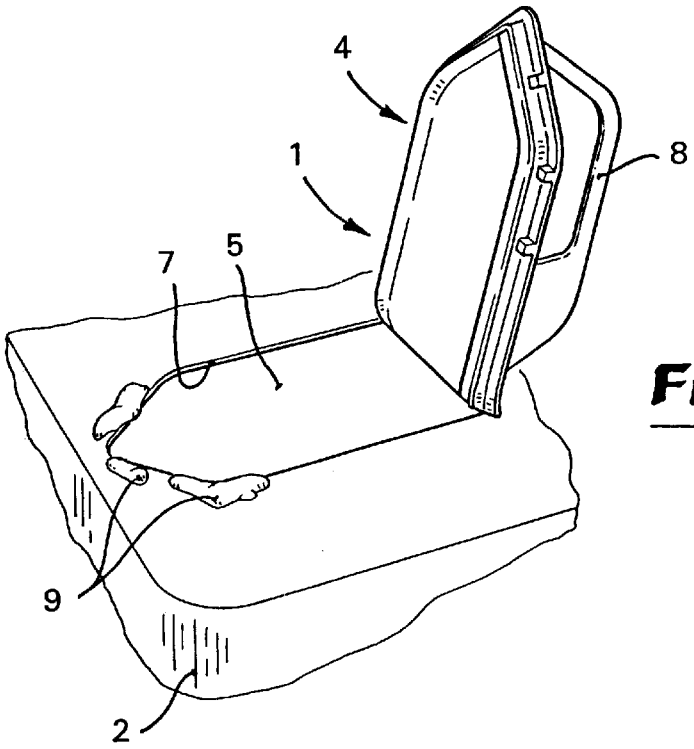
FIG. 1 is a perspective view of an upper portion of a packaging container with an opening arrangement according to the present invention in the opened state.

An opening arrangement 1 according to the present invention is described and shown here in connection with a packaging container 2 of the previously known type carrying the trade mark Tetra Top® and consisting of a casing of paper/plastic laminate and an upper wall surface 3 of injection moulded plastic (polyethylene). The wall surface 3 includes the opening arrangement according to the present invention and, more precisely, a closure device 4 and a prepared pouring opening 5. The pouring opening 5 is defined by a weakening line 6 (FIG. 2) in the plastic material, this weakening line forming the edge 7 of the pouring opening 5 after opening of the opening arrangement. The wall surface 3 and, thereby also the opening arrangement 1 is, as previously mentioned, manufactured by injection moulding of a thermoplastic material and is therefore flexible and resiliently yieldable and also ductile to a certain degree. As a result, it will be possible to design the closure device 4 as a part of the wall surface 3 which, because of the flexibility of the material after opening, may be folded to the position illustrated in FIG. 1, and thereafter once again downwardly folded and utilised for reclosure of the pouring opening 5, as will be described in greater detail below. FIG. 1 also shows how the closure device 4 includes an integral gripping member 8 which extends upwards from the wall surface 3 of the packaging container and is thereby easy for the consumer to grasp. On the wall surface 3, it is also shown how residues 9 of the contents of the packaging container have remained along the edge 7 after a part of the contents of the packaging container has been poured out.

Figure 2:
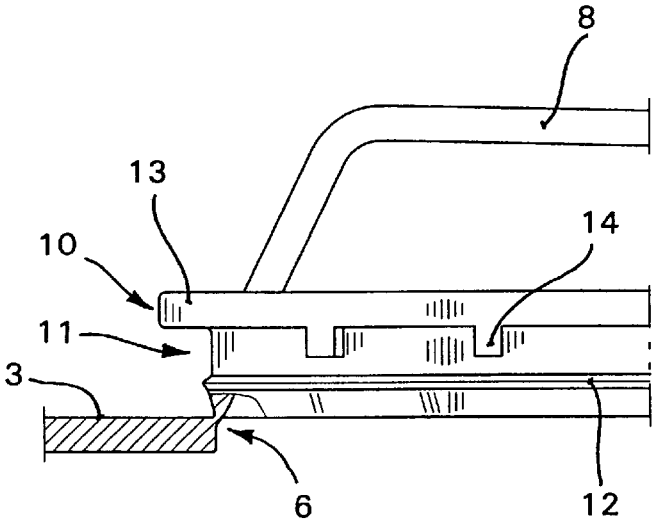
FIG. 2 shows, partly in cross section, a portion of the opening arrangement according to FIG. 1 in the unopened state.
Figure 3:
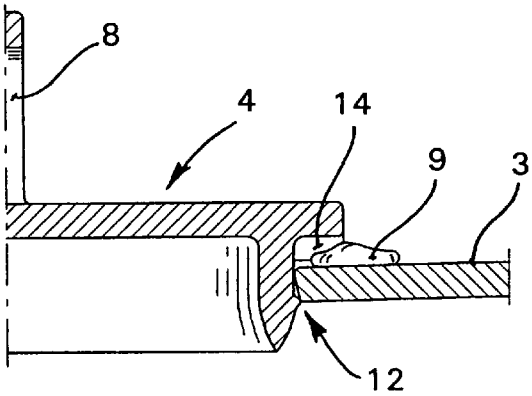
FIG. 3 is a cross section through a portion of the opening arrangement of FIG. 1 in the reclosed state.

As is particularly apparent from FIG. 2, the closure device 4 includes a substantially planar rear or upper compression portion 10 at whose underside a front sealing portion 11 extends substantially vertically downwards, i.e. substantially at 90° to the plane of the compression portion 10 extending parallel with the wall surface 3. The sealing portion 11 is, as will be particularly apparent from FIG. 3, substantially tubular and includes an outer sealing lip 12 which is located a slight distance above the lower edge of the sealing portion 11 which, along the weakening line 6, connects the closure device 4 with the upper wall surface 3 of the packaging container. The weakening line 6 may extend around the entire closure device 4 or, as is shown in FIG. 1, along its front end, in which event the rear end of the closure device 4 is united with the wall surface 3 in a manner similar to a hinge. The part of the sealing portion 11 located beneath the sealing lip 12 is gently tapering in a downward direction, while the part of the sealing portion 11 located above the sealing lip 12 extends substantially vertically. The sealing portion 11 has an area which is substantially equal to or slightly greater than the area of the of the pouring opening 5, while the compression portion 10 has a larger area with a projecting flange 13 at whose lower part a number of arrest heels 14 are located. The arrest heels are thus disposed at the end of the sealing portion 11 facing towards the compression portion 10 and are preferably connected to both the sealing portion 11 and the compression portion 10. The arrest heels are distributed along the circumference of the closure device or the sealing portion 11, or at least along that part of the opening arrangement 1 which is active, i.e. that part over which the contents pass on being poured out of the packaging container. In order to fulfil their intended function, the heels must be of relatively slight surface extent, and it has proved in practice that the heels should have a maximum width of approx. 3 mm. For reasons of production engineering, it is less practical in connection with injection moulding to design the heels to be narrower than 0.5 mm, which also essentially constitutes the lower limit if the heels, given that they are manufactured of flexible plastic material, are to have sufficient mechanical strength to fulfil their function on reclosure of the opening arrangement. For corresponding reasons, the height of the heels is also preferably between 0.5 and 3 mm. Injection moulding of the opening arrangement in one piece with the upper wall surface of the packaging container makes it possible, as is apparent from FIG. 2, to injection mould the opening arrangement with the closure device in an upper position, in which the lower end of the sealing portion 11 is connected by means of the weakening line 6 to the wall surface 3. When the opening arrangement has been opened and the material has thus been ruptured along the weakening line 6, the closure device will, when the packaging container is reclosed, be pressed further down into the packaging container, i.e. until such time as the arrest heels 14 abut against the wall surface 3 and the sealing lip 12 comes into abutment against the lower portion (FIG. 3) of the edge 7. As a result, the wall thickness of the packaging container, i.e. the height of the edge 7, will determine the distance between the sealing lip 12 and the surface of the arrest heels 14 facing away from the compression portion 10, and this distance should be equal to or slightly less than the wall thickness of the packaging container.

When a packaging container with an opening arrangement according to the present invention has been opened by the consumer, and the desired quantity of contents has been poured out via the pouring opening 5 of the packaging container, certain residual contents 9 will, in any event in some types of contents—principally more viscous contents such as, for example, soured milk or cream—will inevitably remain on the wall surface 3 along the edge 7 of the pouring opening 5. When the packaging container has been reclosed in that the closure device 4 is folded or pressed downwards, the part of the sealing portion 11 located beneath the sealing lip 12 win meet the edge 7 and, because of the flexibility of the material, penetrate down into the pouring opening 5. Continued pressure on the compression portion 10 of the closure device 4 will entail that the sealing lip 12 will pass the edge 7 until the lower end of the arrest heels 14 comes into abutment against the wall surface 3 located around the pouring opening 5. Since the front, active surface of the arrest heels is located a distance of a few millimetres from the underside of the flange 13, residual contents 9 will, with the exception of the narrow regions where the arrest heels 14 are located, be able to remain in the position illustrated in FIGS. 1 and 3. Since the underside of the flange 13 is, as a result, never forcibly pressed against the upper side of the wall surface 3, the risk is obviated of splashing or spraying of contents in connection with the reclosure of the opening arrangement. By adapting the distance from the active surface of the arrest heels 14 and the sealing lip 12 in relation to the height of the edge 7, it will be ensured—despite the lack of abutment between the underside of the flange 13 and the wall surface 3—that the reclosure will be liquid-tight to the desired extent and, in practical tests, this design and construction has proved to give a completely adequate result, both as regards the absence of splashing of contents and as regards the tightness of the reclosure.

As a result of the apparently insignificant change of the prior art construction, i.e. the addition of the arrest heels 14 and the adaptation of the distance between their active, lower portion and the sealing lip 12 to the height of the edge 7, splash-free reclosure is thus made possible without necessitating any more extensive or expensive reconstruction of the injection moulding tool. Material consumption is altered but insignificantly, nor do any complicated or costly factors arise. In other types of opening arrangements, the heels may be realised by other means, for example by additional material, by the application of washers, threads or the like, but the principle of the invention is the same, namely to prevent two larger, planar surfaces from meeting forcibly at the moment of reclosure.

What is claimed is:

1. An opening arrangement for packaging containers comprising a wall surface with an openable pouring opening and a closure device with a front end in the form of a sealing portion depressable in the pouring opening and a rear end in the form of a compression portion whose cross sectional area is greater than the cross sectional area of the pouring opening, wherein arrest heels mechanically cooperable with the edge of the pouring opening are disposed at the end of the sealing portion facing towards the compression portion.

2. The opening arrangement as claimed in claim 1, wherein the compression portion has a projecting flange which, at its side facing towards the sealing portion, is connected to the arrest heels.

3. The opening arrangement as claimed in claim 1, wherein the heels are distributed along the circumference of the sealing portion.

4. The opening arrangement as claimed in claim 1, wherin the heels are of a height of 0.5–3 mm.

5. The opening arrangement as claimed in claim 1, wherein die heels have a width of 0.5–3 mm.

6. The opening arrangement as claimed in claim 1, wherein the opening arrangement and the wall surface constitute a unit, discrete and separate by means of a weakening line defining the pouring opening.

7. The opening arrangement as claimed in claim 6, wherein the opening arrangement and the wall surface are injection moulded in one piece.

8. The opening arrangement as claimed in claim 1, wherein the sealing portion includes a sealing lip, the distance between the sealing lip and the end of the arrest heels facing away from the compression portion is equal to or slightly less than the wall thickness of the packaging container.

* * * * *